United States Patent [19]

McMonigle et al.

[11] 4,290,874

[45] Sep. 22, 1981

[54] GASKET FOR SEALING JOINTS IN CARBONACEOUS ELEMENTS IN ELECTROLYSIS CELL

[75] Inventors: Matthew J. McMonigle, New Kensington; Chester H. Klingensmith, Leechburg, both of Pa.

[73] Assignee: Aluminum Company of America, Pittsburgh, Pa.

[21] Appl. No.: 162,754

[22] Filed: Jun. 25, 1980

[51] Int. Cl.[3] ..... C25C 3/08; C25C 7/04; C25B 11/12

[52] U.S. Cl. ..... 204/243 R; 204/67; 204/279; 204/294

[58] Field of Search ..... 204/243 R, 243 M, 244, 204/245-247, 67, 279, 294

[56] References Cited

U.S. PATENT DOCUMENTS

| | | | |
|---|---|---|---|
| 3,726,738 | 4/1973 | Gellon et al. | 204/294 X |
| 3,764,509 | 10/1973 | Etzel et al. | 204/243 R |
| 4,140,594 | 2/1979 | Rogers et al. | 204/243 R X |
| 4,151,061 | 4/1979 | Ishikawa et al. | 204/67 X |
| 4,154,661 | 5/1979 | Hyland et al. | 204/67 X |
| 4,160,715 | 7/1979 | Kinosz et al. | 204/243 R |
| 4,175,022 | 11/1979 | Vadla et al. | 204/243 R |
| 4,179,346 | 12/1979 | Das et al. | 204/67 |

*Primary Examiner*—Donald R. Valentine
*Attorney, Agent, or Firm*—David J. Hill

[57] ABSTRACT

An improved cell is disclosed for producing metal by electrolytic reduction of a metal halide dissolved in at least one molten halide of higher electrodecomposition potential than the metal halide. The cell includes a plurality of cell elements, including an inner refractory lining and a plurality of carbonaceous elements. Included among the carbonaceous elements are carbonaceous lining elements located inside of and abutting a portion of the inner refractory lining and carbonaceous electrode elements abutting the inner refractory lining. In a preferred embodiment of the invention, some carbonaceous lining elements abut other carbonaceous lining elements, and some carbonaceous electrode elements abut other carbonaceous electrode elements. The improved cell also includes carbon felt gaskets located between at least some of the abutting elements for sealing of the joints of abutment in order to minimize the effects of physical shifts in the carbonaceous elements.

4 Claims, 3 Drawing Figures

GASKET FOR SEALING JOINTS IN CARBONACEOUS ELEMENTS IN ELECTROLYSIS CELL

BACKGROUND OF THE INVENTION

The present invention relates to monopolar or bipolar electrolysis cells for the production of metal by the reduction of a metal halide dissolved in at least one molten halide of higher electrodecomposition potential than the metal halide. More particularly, this invention relates to an improvement in such cells for sealing of at least some of the joints of abutment between the various carbonaceous elements and adjacent cell elements located therein in order to avoid the deleterious consequences of physical shifts in the carbonaceous elements during operation of the cell.

A cell in which the present invention may be utilized is described in U.S. Pat. No. 4,179,346 of Das et al. This cell includes an outer steel shell which is lined with refractory brick made of thermally insulating, electrically nonconductive material. In the bottom of the cell is a graphite lined refractory sump for collecting the metal produced in the cell. Above the sump are located a cathode, at least one intermediate bipolar electrode and an anode, all of carbonaceous material, preferably of graphite. These cell components are arranged in a superimposed, spaced relationship defining inter-electrode spaces between the anode and the uppermost electrode, between each pair of intermediate electrodes, and between the lowermost electrode and the cathode. The components are preferably disposed horizontally within a vertical stack. The cathode is preferably supported at each end on the graphite walls of the sump. The remaining electrodes are stacked each above the ones below, with their ends abutting the refractory side walls, in a spaced relationship established by interposed refractory spacers.

The cell of Das et al. operates to produce metal from the electrolytic reduction of the metal chloride dissolved in a molten solvent. This electrolysis takes place in each inter-electrode space to produce chlorine on each anode surface thereof and metal on each cathode surface thereof. Passages are provided through the electrodes in order to aid in the establishment and maintenance of a flow of the chloride-solvent bath through each inter-electrode space to remove the metal produced in each space. The bath flow is directed into, across and out of each inter-electrode space by utilization of the chlorine produced as the lifting gas in a gas lift pump which lifts the lighter bath upwardly while permitting heavier molten metal swept from each inter-electrode space to settle in the sump.

An electrode used in the cell of Das et al. may be comprised of two or more electrode pieces or elements which are fit together in the cell to form an assembled electrode. Alternatively, an electrode may be manufactured as a single element. In either event, the electrodes are comprised of a carbonaceous material, preferably graphite grade carbon, which can be produced from coke derived from coal or petroleum. In making an electrode element, the coke is calcined to drive off volatile impurities, and the calcined coke is blended with a pitch binder to provide a mixture having a pitch content of about 10-30%. This mixture is shaped in the desired size and configuration and baked at about 700°-1600° C. to drive off volatiles from the pitch binder. The baked electrode element is then usually immersed in liquid pitch to impregnate it and increase its density, after which it is again baked at about 700°-1600° C. to drive off volatiles from the pitch. Finally, the carbonaceous material is heated to a temperature of about 2000°-3100° C. for a period sufficient to convert it to graphite.

The present invention may also be utilized in a cell such as is illustrated in U.S. Pat. No. 4,140,594 of Rogers et al. This cell is similar to that illustrated in U.S. Pat. No. 4,179,346 of Das et al., but it includes two stacks of electrodes. It also includes an inner side wall lining of carbonaceous material, which is positioned inside of the refractory brick lining alongside and above the location of the anodes. This lining, as well as the sump lining which is found in both the cell of Rogers et al. and that of Das et al., is formed from carbonaceous elements such as graphite slabs which are fitted into machined recesses in the refractory brick lining.

It has been found that, during the operation of the cells of Das et al. or Rogers et al., the carbonaceous elements may be subject to physical shifting within the cell. This shifting may result from mechanical stresses caused by thermal expansion or chemical reaction, or from buoyancy effects due to the relatively close densities of the carbonaceous elements and the molten electrolyte bath in the cell. This shifting of elements may damage the elements, and it may produce gaps in the joints between such elements and adjacent structures. Thus, gaps may appear between carbonaceous elements assembled together, such as electrode elements assembled to form a single electrode, or between any of the carbonaceous elements and the adjacent cell elements. The appearance of these gaps may lead to penetration therethrough of metal and to deviations from the desired flow of halogen gas produced by the electrolysis process. This could result in re-halogenation of the metal and the combination of the metal with the carbon of the carbonaceous elements on the anodic surfaces of the electrodes. Thus, halides and carbides of the metal may build up a sludge-like formation on the anode surfaces, which would interfere with the efficient operation of the cell by reducing the anode-cathode spacing. Continued accumulation of sludge on the anode surfaces could produce electrical short circuits, thus further impairing electrolysis.

The problem of shifting electrode blocks in electrolytic cells has been previously recognized, as evidenced by the disclosure of U.S. Pat. No. 3,764,509 of Etzel et al. This reference discloses a means for minimizing the effect of mechanical stresses on the carbonaceous cathode in an electrolysis cell used for the production of aluminum. According to this reference, buckling or bulging of such a cathode due to mechanical stresses encountered in the operation of the cell can be minimized by providing the cathode in the form of a set of carbonaceous blocks, each block possessing four lateral surfaces, at least an opposed pair of which are inclined at different angles to the vertical. Thus, the assembled cathode obtains, by virtue of the shapes of its component blocks, a mutual wedging of the blocks against upwardly acting forces.

It is also known that a layer of carbonaceous material such as carbon felt may be utilized to prevent contact between the outer metal shell of an electrolysis cell and the metal produced therein. Such contact can provide an electrical pathway through the cell that bypasses the cathode and therefore does not contribute to the production of metal. Such a use of carbonaceous material is described in U.S. Pat. No. 4,160,715 of Kinosz et al. This reference discloses an improved lining for an electrolytic cell such as the one previously discussed in connection with U.S. Pat. No. 4,140,594 of Rogers et al. This lining includes a layer of a material such as carbon felt within the refractory lining at the bottom of the side walls and under the floor of the sump, where molten aluminum accumulates. This layer is impenetrable by molten aluminum and serves to insure that molten aluminum does not penetrate to the metal shell of the cell.

It is also known that a barrier of carbonaceous material may be provided in an electrolytic cell to protect the thermal insulation in the bottom of the cell from attack by the bath constituents in the cell. Such attack may cause degradation of the physical and insulating properties of the insulation, thereby making it difficult to control the temperature of the bath within the cell. Proper temperature control is essential for efficient operation of the cell.

U.S. Pat. No. 4,175,022 of Vadla et al. describes the provision of a barrier which includes a graphite sheet above the thermal insulation in the bottom of a cell for the production of aluminum by the electrolytic reduction of alumina in a cryolite bath. According to this reference, a sheet formed from expanded graphite in combination with a thin steel underlay gives excellent protection to the insulation beneath against the migration of cryolite, its decomposition products and the bath components.

SUMMARY OF THE INVENTION

It is an object of the present invention to provide an improved electrolysis cell having a plurality of cell elements, including an inner refractory lining and a plurality of carbonaceous elements. Included among the carbonaceous elements are carbonaceous lining elements located inside of and abutting a portion of the inner refractory lining and carbonaceous electrode elements abutting the inner refractory lining. The improved cell may be operated without deleterious effects caused by physical shifting of the various carbonaceous elements. It is a further object of this invention to provide such a cell which may be constructed with carbonaceous elements of relatively simple shapes and of sizes which are easily handled. In accordance with these and other objects, an improved cell is provided with carbon felt gaskets located between at least some of the abutting elements for sealing of the joints of abutment in order to avoid the deleterious consequences of physical shifts in the carbonaceous elements during operation of the cell.

In order to facilitate an understanding of the invention, its features are illustrated in the accompanying drawings and a detailed description thereof follows. It should be understood nevertheless that it is not intended that the invention be limited to the particular embodiment shown. Various changes and alterations are contemplated such as would ordinarily occur to one skilled in the art to which the invention relates.

DETAILED DESCRIPTION OF THE INVENTION

Figure 1:
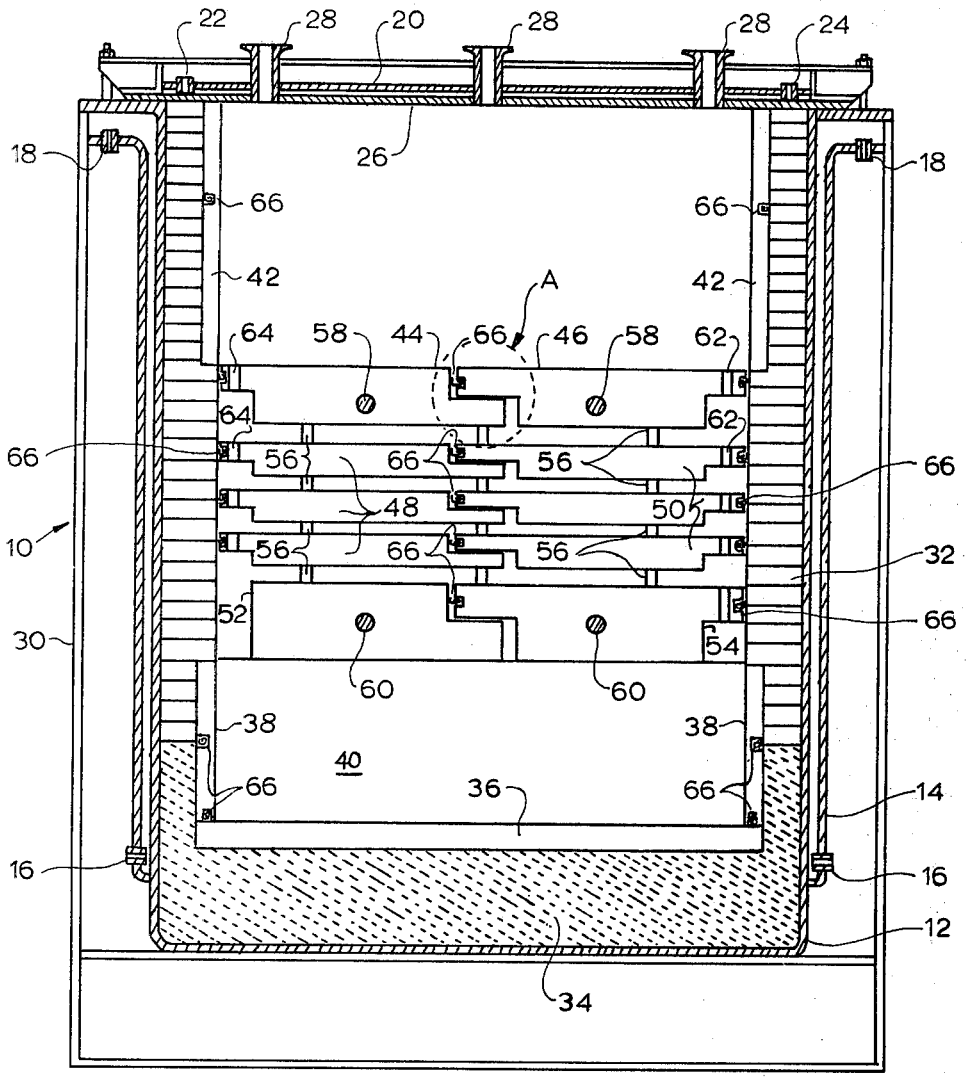
FIG. 1 is a schematic elevational cross section of an electrolysis cell constructed in accordance with the principles of this invention.

The cell of FIG. 1 may be employed to produce metal by electrolytic reduction of a metal halide dissolved in at least one molten halide of higher decomposition potential than the metal halide. However, this cell is particularly appropriate for employment in the production of metal such as aluminum from the electrolytic reduction of the metal chloride dissolved in a molten halide mixture containing sodium chloride (NaCl) and lithium chloride (LiCl). Consequently, the discussion that follows describes this improved cell in terms that relate to the production of metal such as aluminum by such method.

Cell 10 includes outer shell 12, preferably of steel, bounded on its sides by cooling jacket 14. A coolant such as water flows through the jacket during operation of the cell to remove heat therefrom. The coolant enters jacket 14 at inlet ports 16, and is removed at exit ports 18. A similar cooling jacket 20 with inlet ports 22 (only one of which is shown) and exit ports 24 (only one of which is shown) is provided for cell cover 26. Located in the cover and extending therethrough are accessory ports 28. Such ports may be used for tapping metal from the cell, feeding metal chloride to the cell, venting chlorine gas from the cell, or for inspection, sampling or insertion of monitoring instruments. A structural containment 30 encloses shell 12 and cooling jacket 14, and provides support for the cell.

The cell is lined with an inner refractory brick lining 32. In the lower portion of the cell is located inner refractory sump lining 34. Located adjacent to and inside of lining 34 are carbonaceous lining elements 36 and 38. These elements, preferably made of graphite, provide the boundary for sump 40, where metal produced in the cell is collected. Inner side wall lining element 42, preferably of graphite, are positioned inside of brick lining 32 in the upper portion of the cell. Carbonaceous elements 36, 38 and 42 are fitted into machined recesses in brick lining 32.

Within the cell cavity are a plurality of carbonaceous electrode elements which are assembled to form the electrodes of the cell. Elements 44 and 46 comprise the upper terminal anode while elements 48 and 50 comprise the intermediate bipolar electrodes (three being shown) and elements 52 and 54 comprise the lower terminal cathode. The electrodes are diposed horizontally within a vertical stack. The cathode, comprised of elements 52 and 54, is supported on carbonaceous sump lining elements 38. The remaining electrodes are stacked each above the ones below, with their ends abutting refractory side walls 32, in a spaced relationship established by interposed refractory spacers 56. These spacers are sized to closely space the electrodes, as for example to space them with their opposed surfaces separated by $\frac{3}{4}$ inch or less. In the illustrated embodiment, four inter-electrode spaces are provided between opposed electrodes, one between the terminal cathode and the lowest of the bipolar electrodes, two between successive pairs of intermediate bipolar electrodes and one between the highest of the bipolar electrodes and the terminal anode. Each inter-electrode space is bounded by an upper surface provided by the bottom of one electrode (which surface functions as an anode surface) opposite a lower surface provided by the top of another electrode (which surface functions as a cathode surface).

The anode has a plurality of electrode bars 58 therein which serve as positive current leads, and the cathode has a plurality of collector bars 60 therein which serve as negative current leads. These bars extend through the cell wall and are suitably insulated from shell 12. When an appropriate voltage is imposed between the terminal anode and the terminal cathode, a bipolar character is imparted to the intermediate electrodes.

The cell illustrated in FIG. 1 operates to produce metal such as aluminum from the electrolytic reduction of the metal chloride dissolved in a molten solvent. When this cell is utilized to produce aluminum, therefore, the bath composition normally is composed essentially of aluminum chloride dissolved in one or more halides of higher electrodecomposition potential than aluminum chloride. These halides will usually be made up of alkali metal chlorides, although other alkali metal halides and alkaline earth halides may also be employed. A presently preferred bath composition includes an alkali metal chloride base composition made up of about 50–75% by weight sodium chloride and 20–50% by weight lithium chloride. Aluminum chloride is dissolved in such base composition to provide a bath from which aluminum may be produced by electrolysis, and an aluminum chloride content of about 1.5–10% by weight of the bath will generally be desirable.

Electrolysis takes place under these conditions in each inter-electrode space to produce chlorine on each anode surface thereof and aluminum on each cathode surface thereof. Passages 62 and 64 are provided through the electrodes in order to aid in the establishment and maintenance of a flow of bath through each inter-electrode space to remove the metal produced in each space. The bath flow is directed into, across and out of each inter-electrode space by utilization of the chlorine produced as the lifting gas in a gas lift pump which lifts the lighter bath upwardly while permitting heavier molten metal swept from each inter-electrode space to settle in sump 40.

Figure 1A:
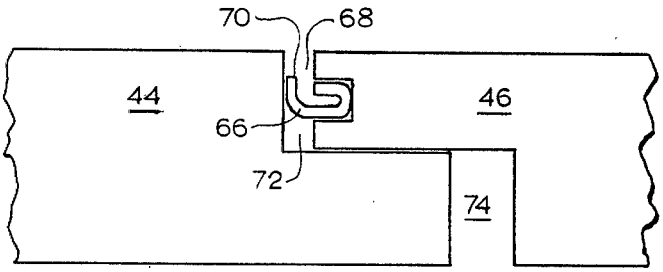
FIG. 1A is an enlarged view of the portion of the cell indicated by the arrow A in FIG. 1.

In accordance with the present invention, carbon felt gaskets are provided between at least some of the abutting elements. Thus, as illustrated in FIGS. 1 and 1A, gaskets 66 are provided between the refractory side walls (32 and 34) and carbonaceous lining elements 38 and 42, and between refractory side walls 32 and carbonaceous electrode elements 44, 46, 48, 50 and 54. Gaskets 66 are also provided between abutting carbonaceous elements that are assembled together to form various cell components. Thus, such gaskets are provided between electrode elements 44 and 46 which are assembled to form the terminal anode, electrode elements 48 and 50 which are assembled to form the intermediate bipolar electrodes, electrode elements 52 and 54 which are assembled to form the terminal cathode, and lining elements 36 and 38 which are assembled to form the sump boundary lining.

Figure 2:
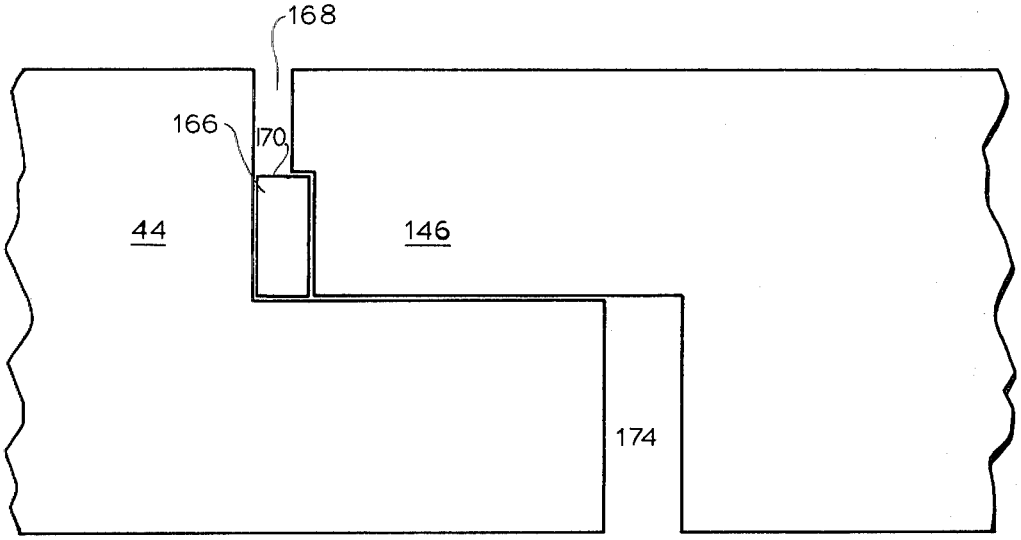
FIG. 2 is a schematic elevational cross section of a portion of an electrolysis cell which illustrates an alternative to the gasket configuration shown in FIGS. 1 and 1A.

Carbon felt gaskets are provided in the form of sized pieces of a fabric of matted carbon fibers. Preferably, the gaskets are provided in a thickness of about ¾ inch (19 mm), although gaskets of greater or lesser dimension may also be used. Preferred results are obtained when the gaskets are placed in a U-shaped configuration, or the G-shaped configuration 66 illustrated in FIGS. 1 and 1A, in a notch that has been cut in one of the elements (such as electrode element 46) at the joint to be sealed. Good results may also be obtained when the gaskets are placed in the flat configuration 166 illustrated in FIG. 2 in a notch that has been cut in one of the elements (such as electrode element 146) at the joint to be sealed. It has been found that the provision of such gaskets effectively seals the joints of abutment between the various carbonaceous elements and adjacent cell elements to minimize the effects of physical shifting of the carbonaceous elements during operation of the cell. Such shifting may result from mechanical stresses caused by thermal expansion or chemical reaction, or from buoyancy effects which may arise if the density of the carbonaceous elements is less than or approximately equal to that of the molten bath in the cell. It has been observed that because of the elasticity of its fibers, a gasket of this invention will expand to occupy space between a carbonaceous element and an adjacent cell element upon a physical shift by the carbonaceous element. The gasket thus seals any gaps that result from shifting against penetration therethrough by bath constituents, halogen gas or metal produced. While not entirely understood, it is believed that the sealing effect is enhanced because of a reaction between the carbon in the gasket and the aluminum produced in the cell. Aluminum produced in the inter-electrode spaces may sweep through space 68 (see FIG. 1A) or space 168 (see FIG. 2) above the gasket in the joint to be sealed. There it reacts with the carbon in the gasket to form a thin layer of aluminum carbide on exposed surface 70 (see FIG. 1A) or surface 170 (see FIG. 2) of the gasket. This layer acts as an impervious membrane on the gasket. Saturation of the gasket with halogen gas seeping into spaces 72 and 74 (see FIG. 1A) or space 174 (see FIG. 2) from below may also assist in maintaining the integrity of the seal.

The sealing effect achieved by the gaskets reduces the chance of metal accumulation in any gaps adjacent to carbonaceous elements in the cell. Such accumulation could result in re-halogenation of the metal and combination of the metal with the carbon of the carbonaceous elements on the anodic surfaces of the electrodes. The presence of the gaskets thus prevents the accumulation of halides and carbides of the metal on the anode surfaces and thereby helps to maintain proper anode-cathode spacing. Thus, efficient operation of the cell is maintained.

The provision of gaskets between carbonaceous elements and at least some of the abutting elements also reduces the dimensional accuracy required in the production of the carbonaceous elements. Such elements may be sized to fit somewhat loosely into place, since expansion of the gaskets during cell operation will insure proper fitment of the elements. Furthermore, because the appearance of gaps between elements is not as disadvantageous as was previously the case, the various carbonaceous cell elements such as electrodes may be comprised of a plurality of assembled elements.

It should be understood that the above description of the present invention is susceptible to various modifications, changes and adaptations, and that the same are intended to be encompassed within the meaning and range of equivalents of the appended claims.

What is claimed is:

1. A cell for producing metal by electrolytic reduction of a metal halide dissolved in at least one molten halide of higher electrodecomposition potential than the metal halide, said cell having:

(a) a plurality of cell elements, including an inner refractory lining and a plurality of carbonaceous elements, said carbonaceous elements including:

(i) a plurality of carbonaceous lining elements located inside of, adjacent to and abutting a portion of the inner refractory lining, and (ii) a plurality of carbonaceous electrode elements abutting and located adjacent to the inner refractory lining; and (b) carbon felt gaskets located between at least some of the abutting elements for sealing of the joints of abutment in order to minimize the harmful effects of dislocation of such carbonaceous elements.

2. The cell of claim 1 wherein at least some of the carbonaceous lining elements abut other carbonaceous lining elements and carbon felt gaskets are located between at least some of these abutting elements.

3. The cell of claim 1 wherein at least some of the carbonaceous electrode elements abut other carbonaceous electrode elements and carbon felt gaskets are located between at least some of these abutting elements.

4. The cell of claim 1 wherein the metal is aluminum and the metal halide is aluminum chloride.

* * * * *